US011124385B2

(12) United States Patent
Mauguen et al.

(10) Patent No.: US 11,124,385 B2
(45) Date of Patent: Sep. 21, 2021

(54) ELEVATOR ACCESS SYSTEMS FOR ELEVATORS

(71) Applicant: Otis Elevator Company, Farmington, CT (US)

(72) Inventors: Valerie Mauguen, Sully sur Loire (FR); Sebastien Fougeron, Lorris (FR); Gerard Sirigu, Gien (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 441 days.

(21) Appl. No.: 16/181,562

(22) Filed: Nov. 6, 2018

(65) Prior Publication Data

US 2019/0135583 A1 May 9, 2019

(30) Foreign Application Priority Data

Nov. 8, 2017 (EP) ..... 17306542

(51) Int. Cl.

| | |
|---|---|
| ***B66B 5/00*** | (2006.01) |
| ***B66B 13/02*** | (2006.01) |
| ***B66B 9/00*** | (2006.01) |
| ***B66B 13/16*** | (2006.01) |

(52) U.S. Cl.

CPC ..... *B66B 5/0087* (2013.01); *B66B 5/005* (2013.01); *B66B 9/00* (2013.01); *B66B 13/02* (2013.01); *B66B 13/16* (2013.01)

(58) Field of Classification Search

CPC ..... B66B 13/02; B66B 13/16; B66B 5/0087; B66B 5/005

See application file for complete search history.

(56) References Cited

U.S. PATENT DOCUMENTS 2,313,172 A * 3/1943 Rechberger ..... B66B 13/16 187/314

8,490,755 B2 7/2013 Lindberg

FOREIGN PATENT DOCUMENTS

| | | | |
|---|---|---|---|
| CN | 101506079 | A | 8/2009 |
| CN | 202208581 | U | 5/2012 |
| CN | 202369236 | U | 8/2012 |
| CN | 202464974 | U | 10/2012 |
| CN | 104925612 | A | 9/2015 |
| CN | 106853941 | A | 6/2017 |
| CN | 106986258 | A | 7/2017 |
| CN | 206299226 | U | 7/2017 |
| CN | 206337917 | U | 7/2017 |
| EP | 1728754 | | 12/2006 |
| EP | 1471028 | B1 | 2/2007 |

(Continued)

OTHER PUBLICATIONS

Machine Translation of FR 2947254.*

(Continued)

*Primary Examiner* — Diem M Tran

(74) *Attorney, Agent, or Firm* — Cantor Colburn LLP

(57) ABSTRACT

Elevator access systems and methods including a key extension having a first portion arranged to engage with a key and a second portion and an access mechanism. The access mechanism includes an extension engagement element arranged to receive and fixedly engage with the second portion of the key extension and an opening element operably connected to the extension engagement element such that operation of the extension engagement element causes operation of the opening element.

17 Claims, 9 Drawing Sheets

(56) References Cited

FOREIGN PATENT DOCUMENTS

| | | | |
|---|---|---|---|
| EP | 2670194 | A1 | 12/2013 |
| EP | 2974989 | A1 | 1/2016 |
| EP | 3056460 | A1 | 8/2016 |
| FR | 2670194 | B1 | 3/1993 |
| FR | 2909650 | A1 | 6/2008 |
| FR | 2947254 | A1 | 12/2010 |
| GB | 541255 | A | 11/1941 |
| GB | 2500979 | A | 10/2013 |
| GB | 2516821 | A | 2/2015 |
| KR | 20060036381 | A | 4/2006 |
| WO | 11015895 | A1 | 2/2011 |
| WO | 2016092337 | A1 | 6/2016 |
| WO | 2017009678 | A1 | 1/2017 |

OTHER PUBLICATIONS

European Search Report, European Application No. 17306542.6, dated Jun. 4, 2018, European Patent Office; European Search Report 9 pages.

* cited by examiner

ELEVATOR ACCESS SYSTEMS FOR ELEVATORS

CROSS REFERENCE TO RELATED APPLICATIONS

This application claims the benefit of European Application No. 17306542.6, filed Nov. 8, 2017, which is incorporated herein by reference in its entirety.

BACKGROUND

The subject matter disclosed herein generally relates to elevator systems and, more particularly, to access systems and devices for locks and access to elevator shafts for elevator maintenance.

Elevator systems include locking mechanisms that are useable by mechanics, technicians, and other authorized persons. The locking mechanisms can be part of lintels or door columns or traps inside the car of the elevator systems and thus may be easily accessible by anyone. However, it may be required by safety regulations and/or advantageous to prevent access to and/or operation of the elevator locking mechanisms at certain times (e.g., when a technician or mechanic is performing a maintenance operation) or when authorized access is not proper. Accordingly, devices that prevent access to the elevator system locking mechanisms may be desirable.

SUMMARY

According to some embodiments, elevator access systems are provided. The elevator access systems include a key extension having a first portion arranged to engage with a key and a second portion and an access mechanism. The access mechanism includes an extension engagement element arranged to receive and fixedly engage with the second portion of the key extension and an opening element operably connected to the extension engagement element such that operation of the extension engagement element causes operation of the opening element.

In addition to one or more of the features described above, or as an alternative, further embodiments of the elevator access systems may include a housing, wherein at least the extension engagement element and the opening element are housed within the housing.

In addition to one or more of the features described above, or as an alternative, further embodiments of the elevator access systems may include that the key extension comprises at least one protrusion and wherein the access mechanism includes at least one locking groove, wherein when the key extension is operated within the access mechanism the at least one protrusion moves within the at least one locking groove to prevent removal of the key extension after operation of the access mechanism.

In addition to one or more of the features described above, or as an alternative, further embodiments of the elevator access systems may include that the access mechanism further comprises a securing element and the key extension comprises a stop, wherein when the key extension is inserted into the access mechanism the securing element engages with the stop to prevent removal of the key extension from the access mechanism.

In addition to one or more of the features described above, or as an alternative, further embodiments of the elevator access systems may include that the access mechanism is installed in a landing door lintel of an elevator system.

In addition to one or more of the features described above, or as an alternative, further embodiments of the elevator access systems may include a landing door pin operably connected to a landing door lock of the elevator system and the access mechanism further comprises a blocking element arranged to prevent relocking of the landing door lock.

In addition to one or more of the features described above, or as an alternative, further embodiments of the elevator access systems may include that the access mechanism has a first state in which the access mechanism does not interfere with operation of a landing door lock of an elevator system, a second state wherein the opening element operates to unlock the landing door lock, and a third state wherein the blocking element blocks movement of the landing door pin toward a locked position.

In addition to one or more of the features described above, or as an alternative, further embodiments of the elevator access systems may include that the second portion includes an engagement aperture wherein the engagement aperture is arranged to provide secure and operable engagement between the key extension and the extension engagement element.

In addition to one or more of the features described above, or as an alternative, further embodiments of the elevator access systems may include that the opening element is integrally formed with the extension engagement element.

According to some embodiments, elevator systems are provided that include any of the elevator access systems described herein. The elevator systems include an elevator shaft with an elevator car moveable within the elevator shaft and a plurality of landings along the elevator shaft, each landing having a landing door. The elevator access systems are installed at at least one of the landing doors.

According to some embodiments, methods of unlocking landing doors of elevator systems are provided. The methods include inserting a key extension into an access mechanism of an access system, wherein insertion of the key extension engages the key extension with an extension engaging element of the access mechanism, operating the key extension to transition the access system from a first state to a second state, wherein in the first state the access mechanism does not interfere with operation of a landing door lock of the elevator system and the transition from the first state to the second state unlocks the landing door lock, and operating the key extension to transition the access system from the second state to a third state, wherein in the third state the access mechanism prevents the landing door lock from returning to a locked state.

In addition to one or more of the features described above, or as an alternative, further embodiments of the methods may include attaching a key to the key extension to enable manual operation of the key extension.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
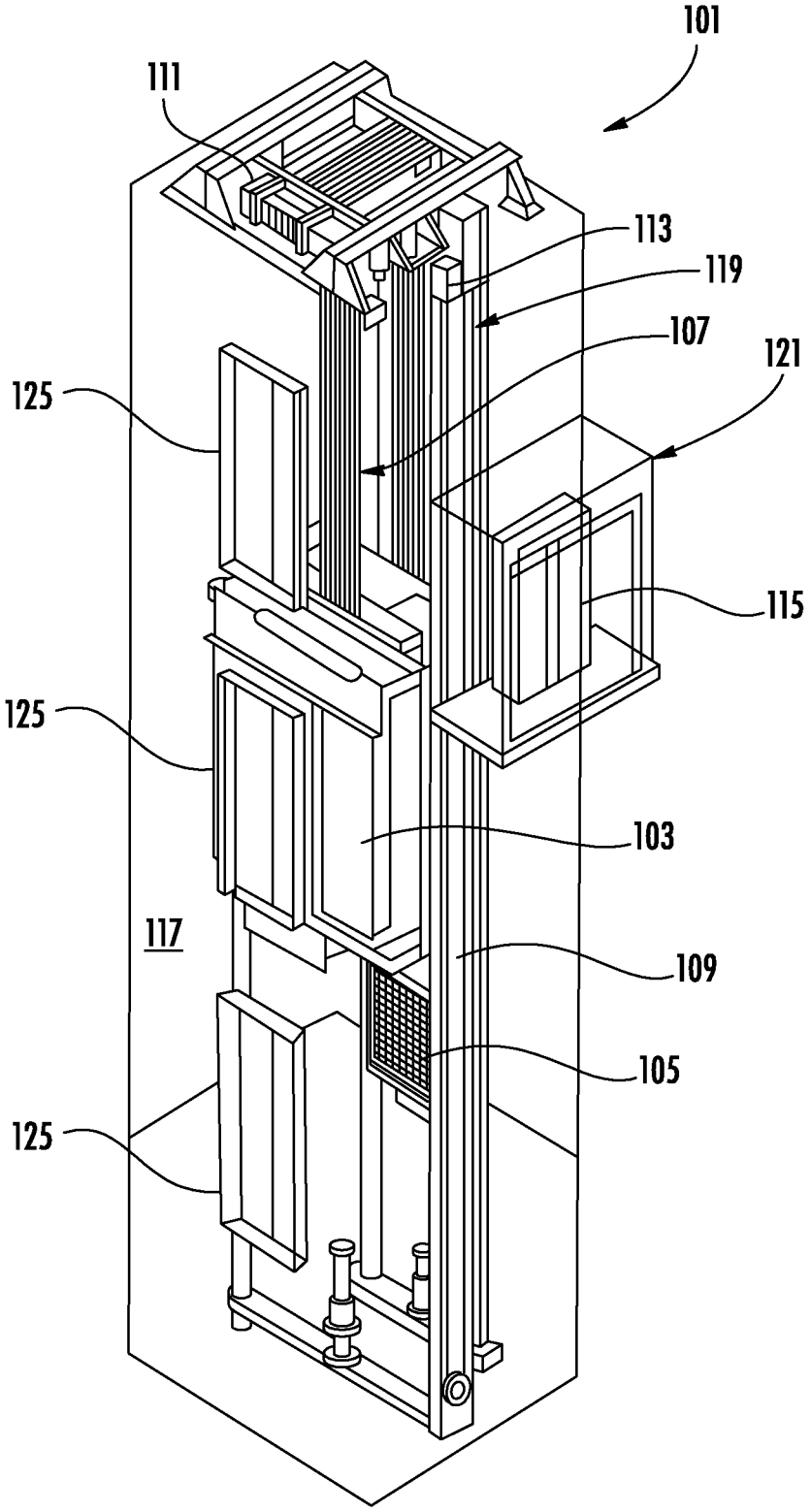
FIG. 1 is a schematic illustration of an elevator system that may employ various embodiments of the present disclosure.

FIG. 1 is a perspective view of an elevator system 101 including an elevator car 103, a counterweight 105, a roping 107, a guide rail 109, a machine 111, a position encoder 113, and an elevator controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which, in this illustrative embodiment, is part of an overhead structure of the elevator system 101, although other arrangements are possible without departing from the scope of the present disclosure. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The elevator controller 115 is located, as shown in the illustrative arrangement, in a controller room 121 of the elevator shaft 117 and is configured to control the operation of the elevator system 101, and particularly the elevator car 103. In other embodiments the controller 115 can be located in other locations, including, but not limited to, fixed to a landing or landing door or located in a cabinet at a landing. The elevator controller 115 may provide drive signals to the machine 111 to control the acceleration, deceleration, leveling, stopping, etc. of the elevator car 103. The elevator controller 115 may also be configured to receive position signals from the position encoder 113. When moving up or down within the elevator shaft 117 along guide rail 109, the elevator car 103 may stop at one or more landings 125 as controlled by the elevator controller 115. Although shown in a controller room 121, those of skill in the art will appreciate that the elevator controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Figure 2:
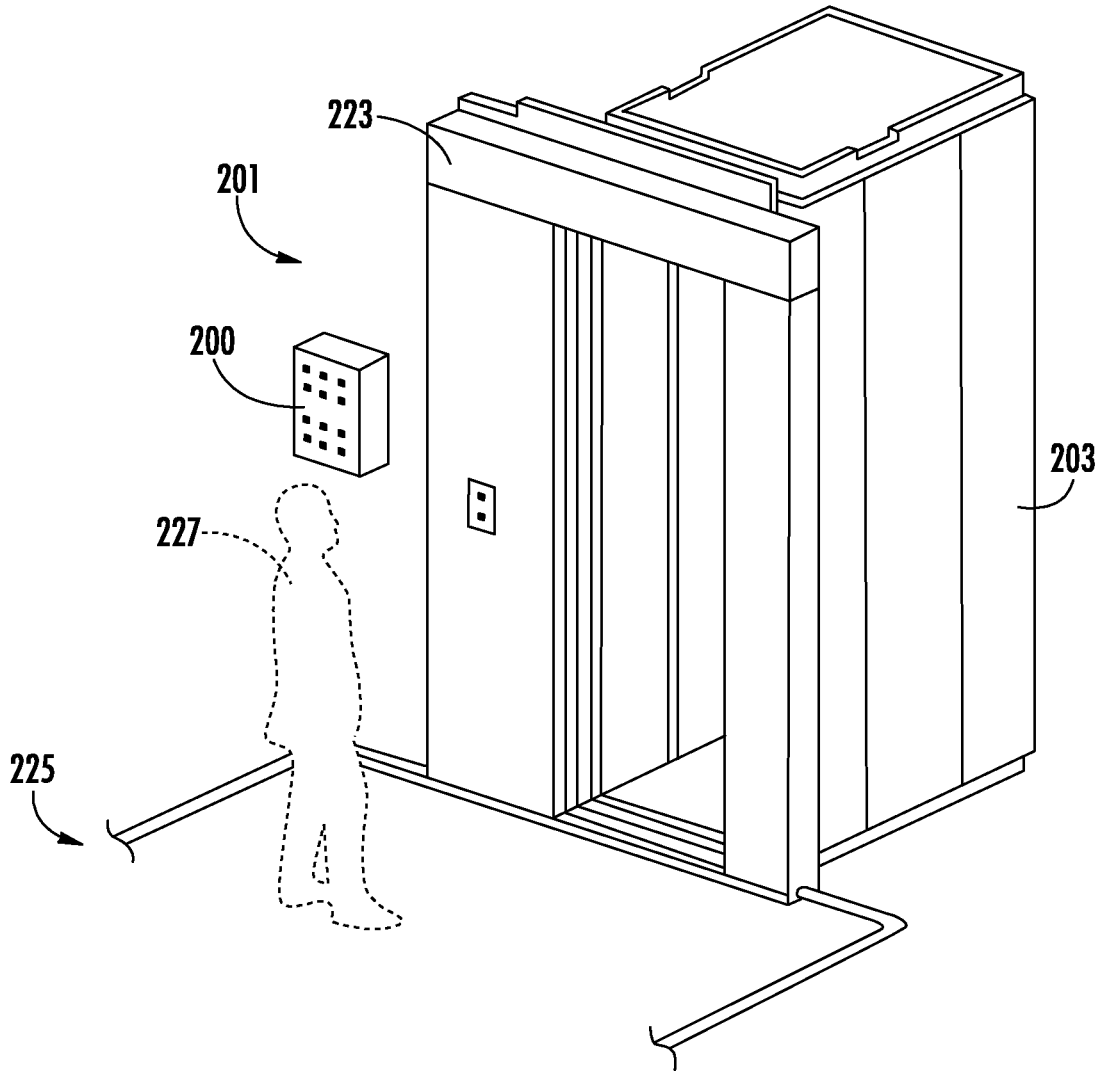
FIG. 2 is a schematic illustration of a landing floor of an elevator system with a hall call panel that may employ various embodiments of the present disclosure.

FIG. 2 is a schematic illustration of an elevator system 201 that may incorporate embodiments disclosed herein. As shown in FIG. 2, an elevator car 203 is located at a landing 225. The elevator car 203 may be called to the landing 225 by a passenger or mechanic 227 that desires to travel to another floor within a building or perform maintenance on a portion of the elevator system 201. In some situations, the mechanic 227 may wish to lock a feature of the elevator system, e.g., the elevator doors, an elevator trap, etc., such that the feature(s) cannot be opened or closed (e.g., to prevent unauthorized persons from accessing the elevator system 201 or portions thereof). For example, such situation may arise when the mechanic 227 wishes to access the elevator car and/or shaft to perform maintenance. Such control or locking can be achieved by a lock hole in a landing door lintel 229 of the elevator system 201 (which may be located at one or more landings 225). It may be advantageous to prevent unauthorized persons from accessing the lock and also enable access in a controlled manner. Accordingly, embodiments provided herein are directed to access systems and devices to enable locking/unlocking locks of elevator systems, the systems securely preventing unauthorized access to the locks of the elevator system.

For example, in some configurations, an access control module 200 (e.g., an emergency and inspection cabinet) can be located at one or more landings 225 of the elevator system. The access control module 200 can include one or more electrical and/or mechanical components that are configured to enable control of and/or access to an associated elevator system. For example, the access control module 200 can include a specialized or unique access key or tool ("access device") for a mechanic or other authorized person to lock and unlock various locks of the elevator system (e.g., lintel door locks, etc.). The access control module 200 can thus enable a mechanic or other authorized person (e.g., emergency personnel) to access an elevator shaft or car for various reasons (i.e., open landing doors).

Figure 3:
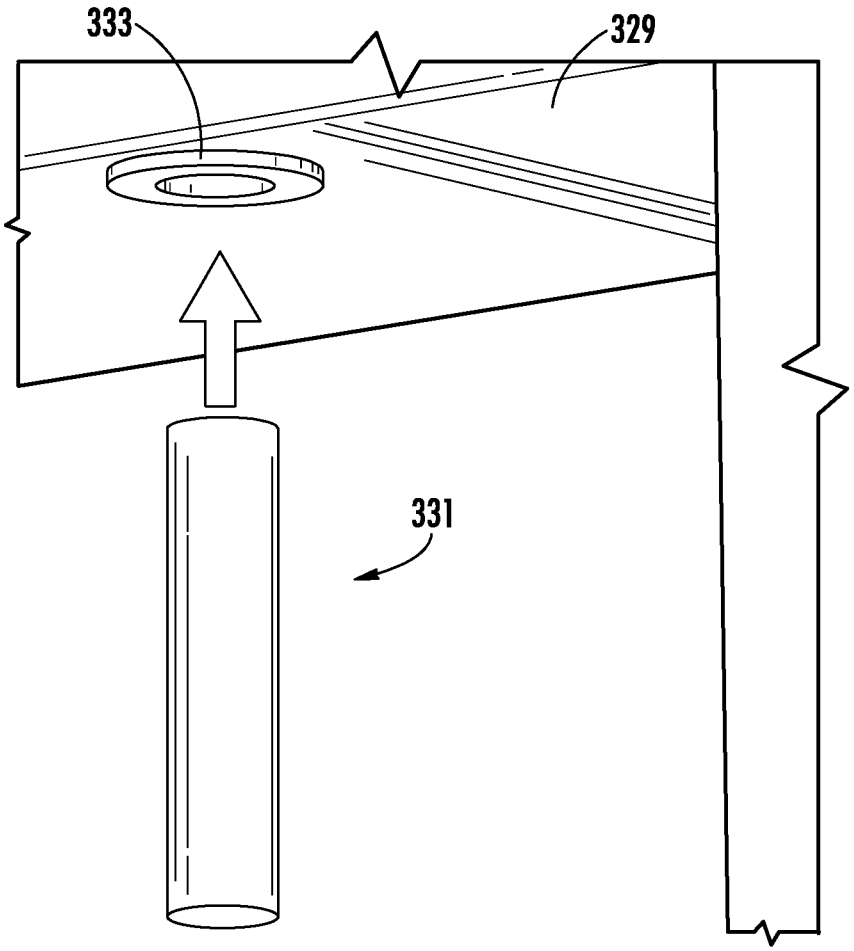
FIG. 3 is a schematic illustration of a lock of an elevator system that can incorporate embodiments of the present disclosure.

Turning to FIG. 3, an access device 331 for use with a lock 333 of an elevator system in accordance with an embodiment of the present disclosure is shown. Although shown and described herein as a key-type "access device," the term "access device" may refer to any access key, tool, or other mechanism that can be used to lock/unlock an elevator landing door. As shown, the lock 333 is an elevator door lock located within a landing door lintel 329 or landing door column of an elevator doorway. The access device 331 is configured to fit within an aperture or keyway of the lock 333. Those of skill in the art will appreciate that the locks and keys described herein are not limited to door locks, but rather may be employed in any locks of elevator systems. For example, in other configurations, the lock may be part of a door column or trap inside an elevator car or may be a lock of other parts of elevator systems. Thus, FIG. 3 is merely illustrative and not intended to be limiting. The lock 333 can include access prevention devices or mechanisms configured within the lock 333 to prevent the access device 331 from entering the aperture of the lock 333. The access device 331 is specifically designed for engagement and use with the specific lock 333.

As provided herein, embodiments of the present disclosure are directed to access devices that are arranged to prevent unauthorized access to an elevator shaft. In accordance with embodiments of the present disclosure, removal of the typical access (e.g., lock 333 and access device 331 shown in FIG. 3) on all landing doors is achieved. Accordingly, landing doors cannot be opened from the landing without a specific device, as described herein. In accordance with embodiments of the present disclosure, a key extension is added to a typical key, thus enabling engagement and operation of a lock at a landing door of the elevator system. This key extension is attached to the key and can be introduced into a hole in the landing door lintel (e.g., a modified keyway or similar hole). Then, rotation of the key with the key extension attached thereto will unlock the landing door. Once the key extension has been used to unlock the landing door, the key extension fixedly engages with the lock and cannot be removed therefrom. Further, in some embodiments, the key extension functions as a block to prevent the landing door interlock to relock (e.g., prevents the landing doors from being reclosed). As such, in some embodiments once the key extension is engaged in the lock of the landing door lintel, the landing doors cannot be closed mechanically or electrically.

Figure 4:
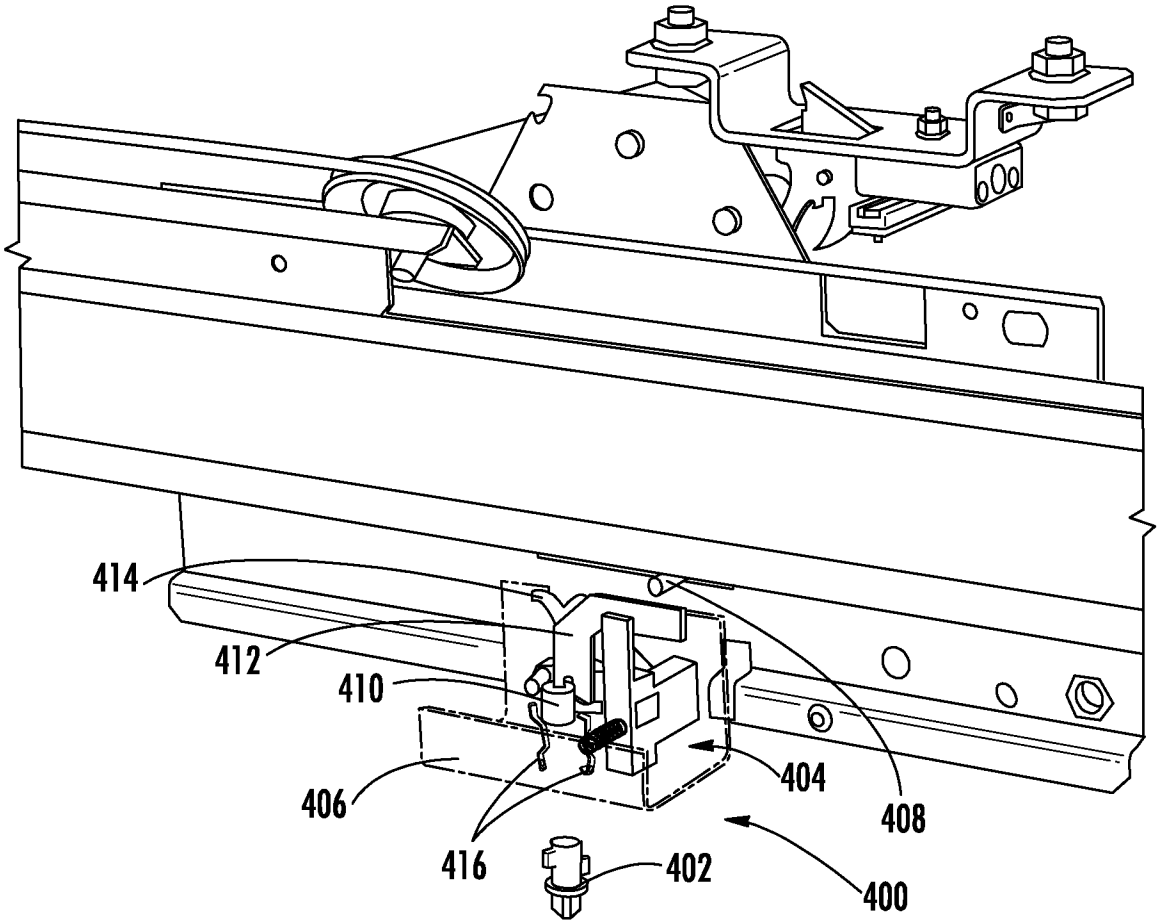
FIG. 4 is a schematic illustration of an access system of an elevator system in accordance with an embodiment of the present disclosure.

Turning now to FIG. 4, an access system 400 in accordance with an embodiment of the present disclosure is shown. The access system includes a key extension 402 and an access mechanism 404. The key extension 402 is a separate component that can be brought to a landing door of an elevator system by an authorized person (along with bringing a key). The key extension 402 is configured to be engaged with the access mechanism 404 and thus allow the key (not shown) to operate access mechanism 404 and thus enable unlocking and opening of a landing door of the elevator system.

As shown, the access mechanism 404 is housed in a landing door lintel 406. A landing door pin 408 is part of a door opening mechanism that is fixedly attached to a landing door that enables opening and/or closing of the landing door. The access mechanism 404 is arranged to interact with the landing door pin 408 to open and subsequently prevent closing of the landing door, as explained herein. In FIG. 4, the landing door pin 408 is shown in a locked or secured position that prevents manual opening of the landing doors. The access mechanism 404 includes an extension engagement element 410, an opening element 412, and a blocking element 414. The opening element 412 is fixedly connected or integrally formed with the extension engagement element 410.

In operation, the key extension 402 can be inserted into a hole in the landing door lintel 406 to securely engage with the extension engagement element 410. A key can then be inserted into or functionally connected to the key extension 402 and rotated to operate the access mechanism 404. As the extension engagement element 410 is rotated by operation of the key, the opening element 414 is rotated to contact and act upon the landing door pin 408. As the landing door pin 408 is moved, the landing door is unlocked and can be opened. As the landing door pin 408 is moved by the rotation of the opening element 410, the blocking element 414 will move into position to prevent the landing door pin 408 from moving back to a locked or secured position. As such, after operation of the access mechanism 400, the landing door cannot be locked again.

Further, in some embodiments, once operation of the key extension 402 is performed, the key extension 402 cannot be removed from engagement with the extension engagement element 410. To achieve this, the access mechanism 400 can include an optional securing element 416 that is arranged to allow the key extension 402 to be inserted into engagement with the extension engagement element 410 and then securely retains the key extension 402 therein. For example, the securing element 416 can be formed from biased locking springs, clips, or other similar structures that allow the key extension 402 to be inserted into the extension engagement element 410, but then prevent removal of the key extension 402 therefrom.

Figure 5:
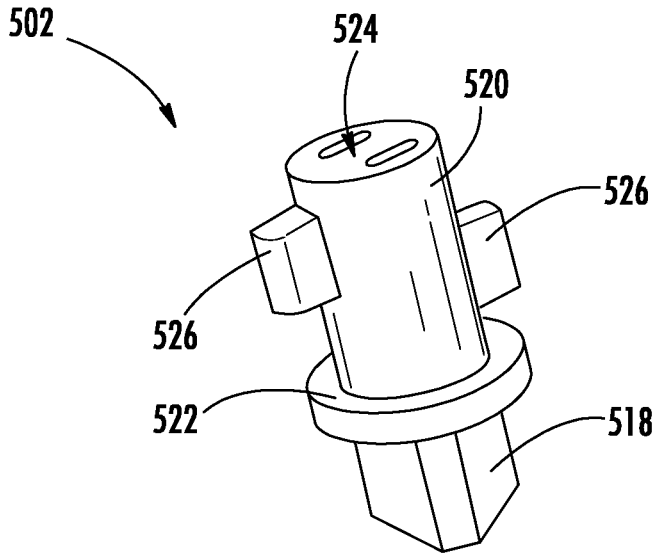
FIG. 5 is a schematic illustration of a key extension in accordance with an embodiment of the present disclosure.

Turning now to FIG. 5, an enlarged illustration of a key extension 502 in accordance with an embodiment of the present disclosure is shown. The key extension 502 is arranged to engage with an access mechanism, as described herein (e.g., engage with an extension engagement element of an access mechanism). The key extension 502 includes a first portion 518 and a second portion 520, with the first portion 518 being at or forming a first end of the key extension 502 and the second portion 520 extending from the first portion 518 toward a second end of the key extension. A stop 522 may, optionally, be located between the first portion 518 and the second portion 520. In some embodiments, the stop 522 is arranged to contact a portion of a landing door lintel when the key extension 502 is inserted into a hole of the landing door lintel. In other embodiments, the stop 522 may be arranged to engage with a securing element of an access mechanism (e.g., securing element 416 shown in FIG. 4).

The first portion 518 is arranged to receive or operate with a key (e.g., a triangular key), as will be appreciated by those of skill in the art. The second portion 520 is arranged to fit into and through a hole in a landing door lintel and to engage with one or more components of an access mechanism and enable operation thereof through rotation or other operation of the key that is engaged with the first portion 518.

The second portion 520 includes an engagement aperture 524 that is arranged, shaped, sized, or otherwise configured to enable engagement with the extension engagement element of an access mechanism. The engagement aperture 524, in some embodiments, may be a shaped slot, groove, or other opening formed in the structure of the second portion 520. The second portion 520 may optionally include one or more protrusions 526. In some embodiments, the protrusions 526 can aid in securing the key extension 502 into and with an access mechanism. Further, in some embodiments, the protrusions 526 can be arranged to engage or otherwise interact with one or more elements of the access mechanism, such as enabling contact and operation of one or more elements or components of the access mechanism. The protrusions 526, in some embodiments, may slide through slots of a landing door lintel and/or slots that are part of the access mechanism, and once operated are positioned to prevent removal of the key extension from the access mechanism. In some embodiments, the engagement aperture 524 is arranged to provide secure and operable engagement between the key extension 502 and an extension engagement element of the access mechanism.

Figure 6A:
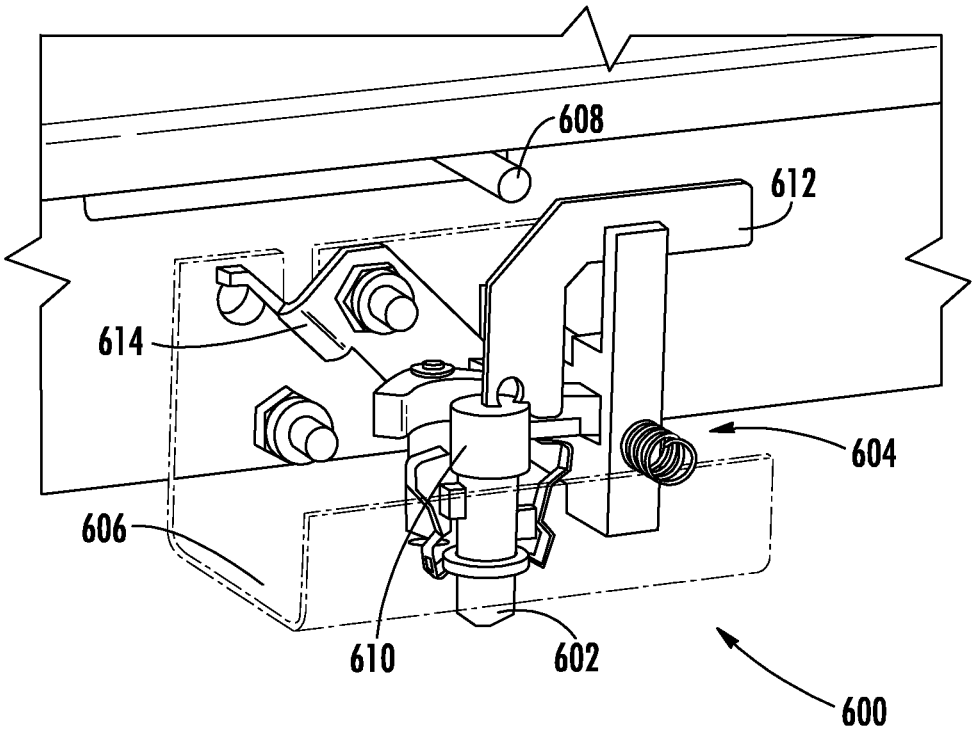
FIG. 6A illustrates a first state of an access system in accordance with an embodiment of the present disclosure.
Figure 6B:
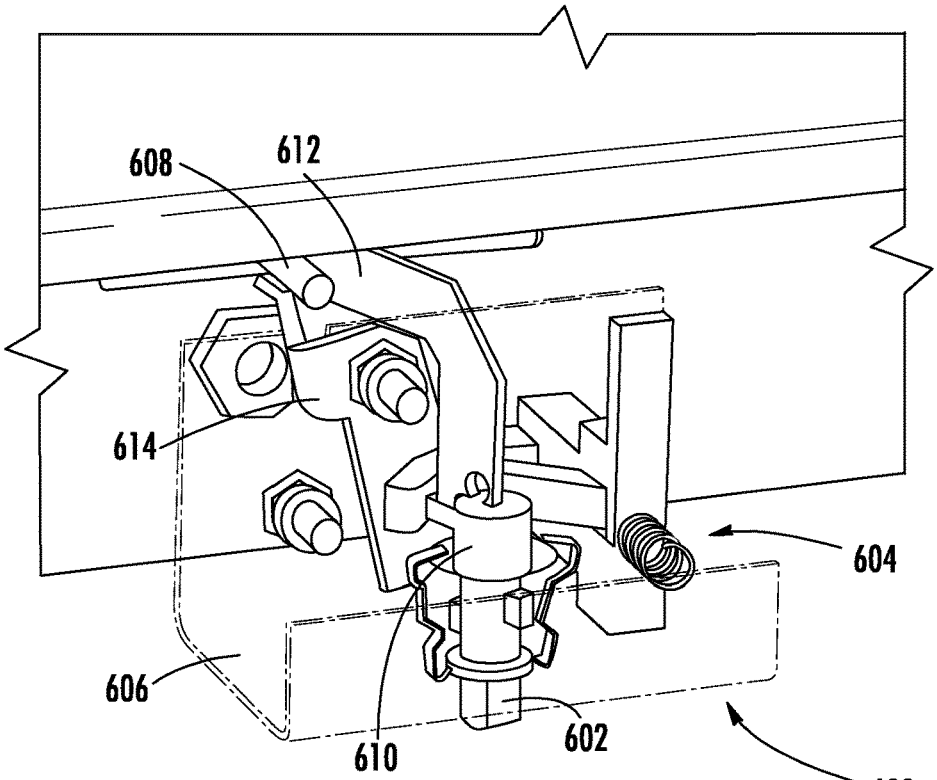
FIG. 6B illustrates a second state of the access system shown in FIG. 6A.
Figure 6C:
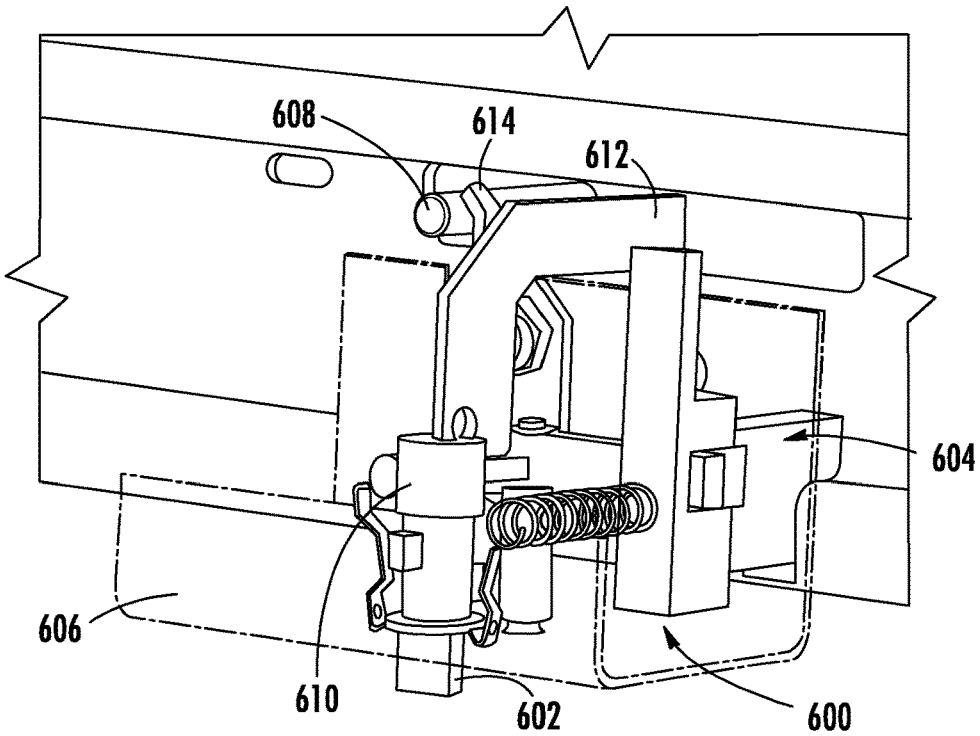
FIG. 6C illustrates a third state of the access system shown in FIG. 6A.

Turning now to FIGS. 6A-6C, a sequence operation of an access system 600 in accordance with an embodiment of the present disclosure is shown. FIG. 6A illustrates a first state of the access system 600, wherein the access system 600 does not interfere with normal operation of a landing door. In FIG. 6A, a key extension 602 is shown engaged with an extension engagement element 610 of an access mechanism 604. FIG. 6B illustrates a second state of the access system 600, wherein the access system 600 has been operated to unlock a landing door lock. FIG. 6C illustrates a third state of the access system 600, wherein the access system 600 prevents relocking of the landing door lock.

With reference to FIG. 6A, showing the first state of the access system 600, the key extension 602 is inserted through a hole of a landing door lintel 606 to engage with the extension engagement element 610 of the access mechanism 604. As shown, the access mechanism includes an opening element 612 and a blocking element 614, similar to that shown and described above. The opening element 612 is fixedly connected to or integrally formed with the extension engagement element 610 such that operation (e.g., rotation) of the extension engagement element 610 will cause the opening element 612 to operate (e.g., rotate) in tandem or therewith. As shown, the opening element 612 of the access mechanism 604 does not contact or otherwise interfere or block operation of a landing door pin 608 that is part of a landing door lock.

Turning now to FIG. 6B, the access system 600 is shown in a second state, wherein the access mechanism 604 has been operated to unlock a landing door lock by interacting with the landing door pin 608. As shown, the opening element 612 has been rotated by rotation of the extension engagement element 610, which in turn has been rotated by operation of the key extension 602, which in turn has been rotated by a key connected to the key extension 602. In operation, as the opening element 612 is rotated from a position in the first state (FIG. 6A) to a position as shown in the second state (FIG. 6B), the opening element 612 contacts and applies force to the landing door pin 608 to move the landing door pin 608 into a position that unlocks a landing door lock, thus allowing for opening of a landing door, and thus enabling access to an elevator shaft.

FIG. 6C illustrates the third state of the access system 600. In the third state, the blocking element 614 prevents the landing door pin 608 from returning to the locked position (shown in FIG. 6A). This is achieved during a transition from the second state (FIG. 6B) to the third state (FIG. 6C). As the opening element 612 urges the landing door pin 608 into the unlocked state, the landing door pin 608 is pushed past the blocking element 614. As the landing door pin 608 is pushed past the blocking element 614, the blocking element 614 will then move into a blocking position, as shown in FIG. 6C. Accordingly, the blocking element 614 will prevent the landing door pin 608 from moving back to a locked position, and thus prevent relocking of the landing door.

Figure 7:
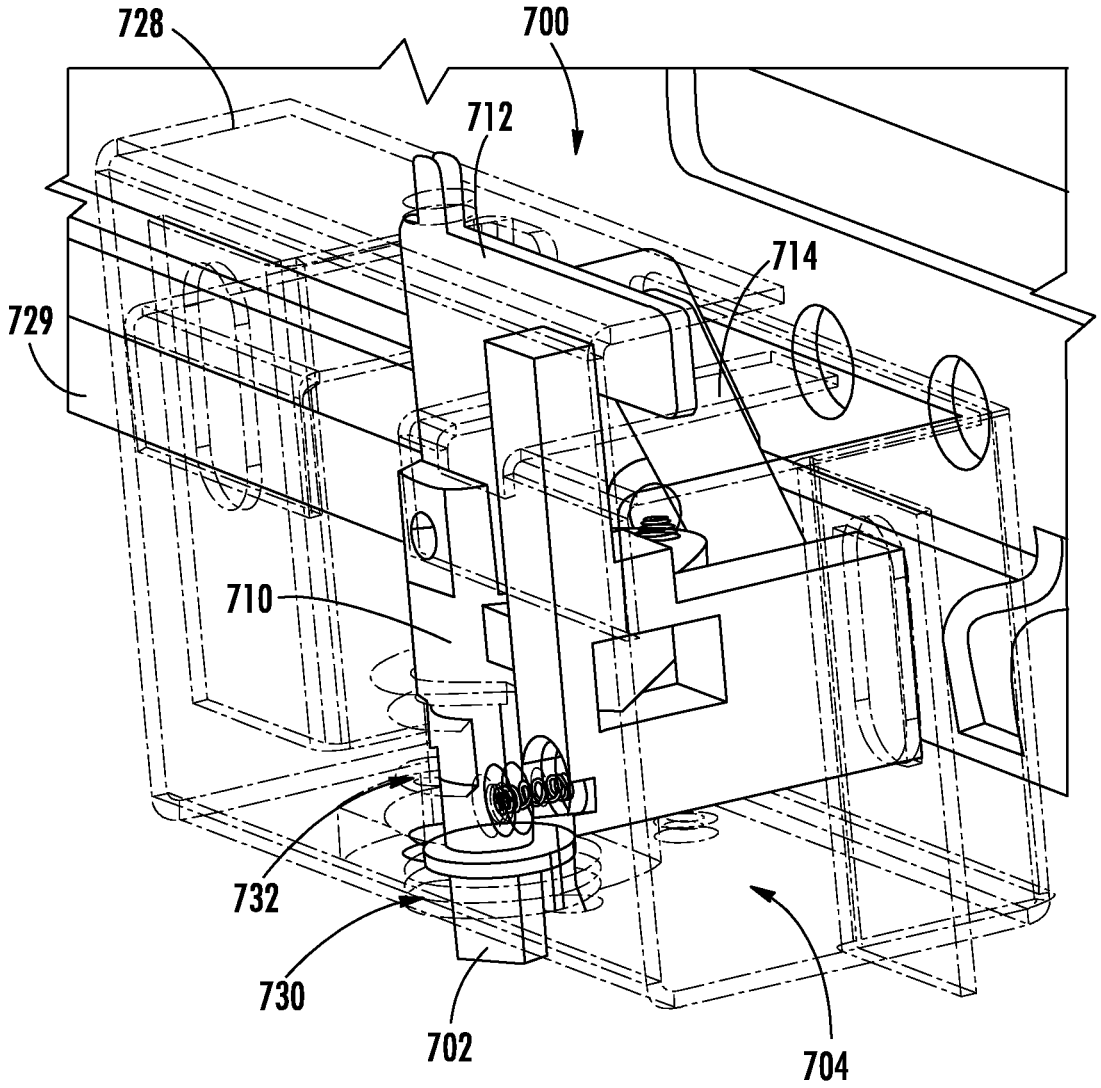
FIG. 7 is a schematic illustration of an access system in accordance with an embodiment of the present disclosure.

Turning now to FIG. 7, a schematic illustration of an access system 700 in accordance with an embodiment of the present disclosure is shown. The access system 700 is operable similar to that shown and described above. In this embodiment, an access mechanism 704 is housed within a housing 728. The housing 728 is mountable or attachable to a landing door lintel 729 and/or can form a portion thereof. The housing 728 includes a keyway aperture 730 to enable insertion of a key extension 702 into engagement with an extension engagement element 710 of the access mechanism 704. As described above, the extension engagement element 710 is operably connected to an opening element 712 and the access mechanism 704 includes a blocking element 714 to operate as shown and described above. As illustratively shown, the housing 728 includes at least one locking groove 732 that is arranged to receive a protrusion of the key extension 702 (e.g., protrusions 526 shown in FIG. 5). The locking groove 732 is sized to enable the protrusion of the key extension to move therein, and once the access system has been operated into the third state (e.g., shown in FIG. 6C), the protrusions of the key extension 702 will interact with locking groove 732 to prevent removal of the key extension 702 from engagement with the extension engagement element 710.

Figure 8:
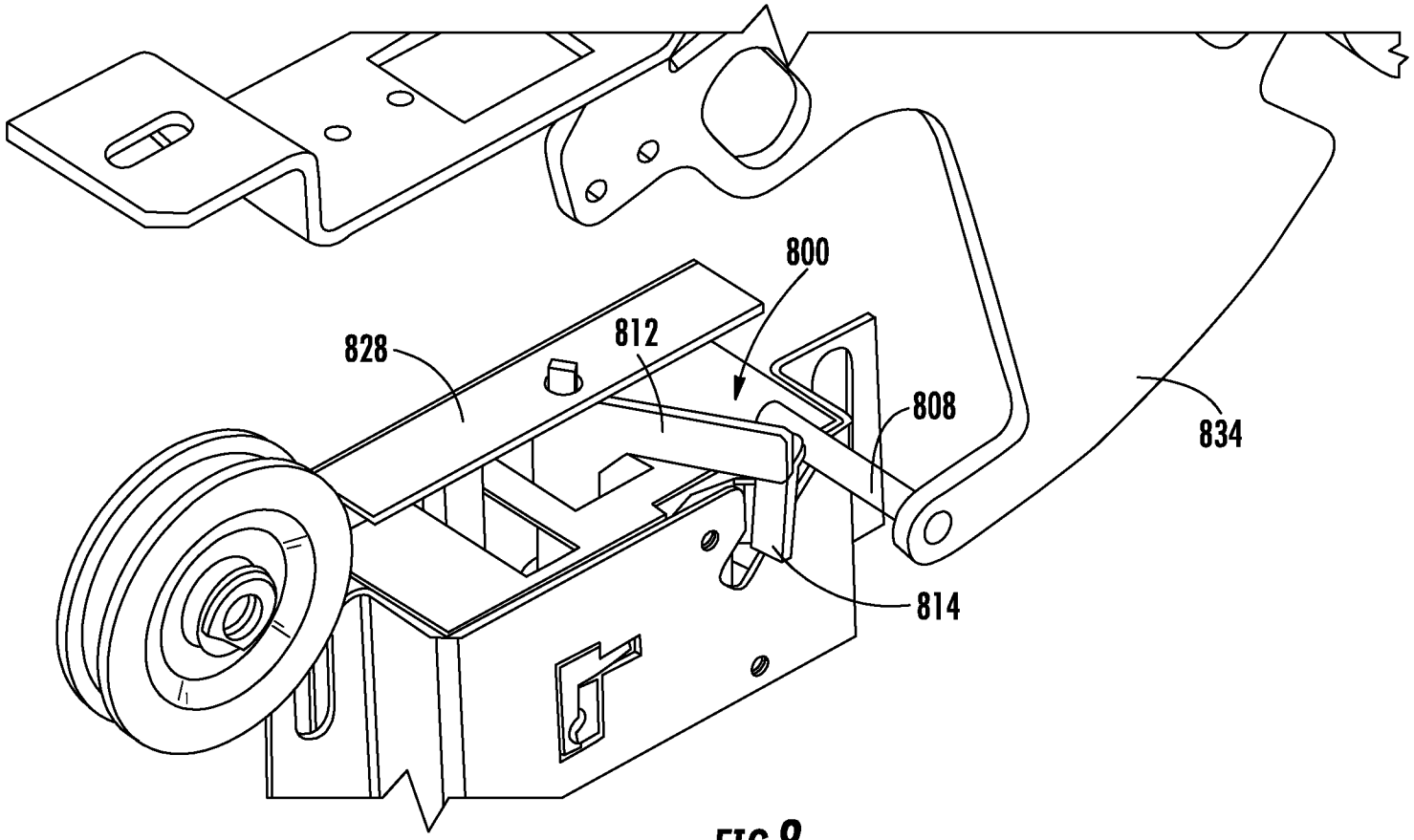
FIG. 8 is a schematic illustration of an access system in accordance with the present disclosure, in the third state.

Turning now to FIG. 8, a schematic illustration of an access system 800 in accordance with an embodiment of the present disclosure is shown. FIG. 8 is illustrative of the access system 800 in the third state, wherein a portion of the access system prevents relocking of a landing door lock. As shown, the access system 800 includes a housing 828 that houses elements of an access mechanism, including, but not limited to, an opening element 812 and a blocking element 814. As noted, in this illustration, the access system 800 has been operated to the third state, wherein the opening element 812 has urged a landing door pin 808 to move such that a landing door lock 834 is moved into an unlocked position. Further, as shown, the blocking element 814 is moved into position to prevent movement of the landing door pin 808 back into an unlocked position, thus preventing the landing door lock 834 from relocking a landing door.

Figure 9:
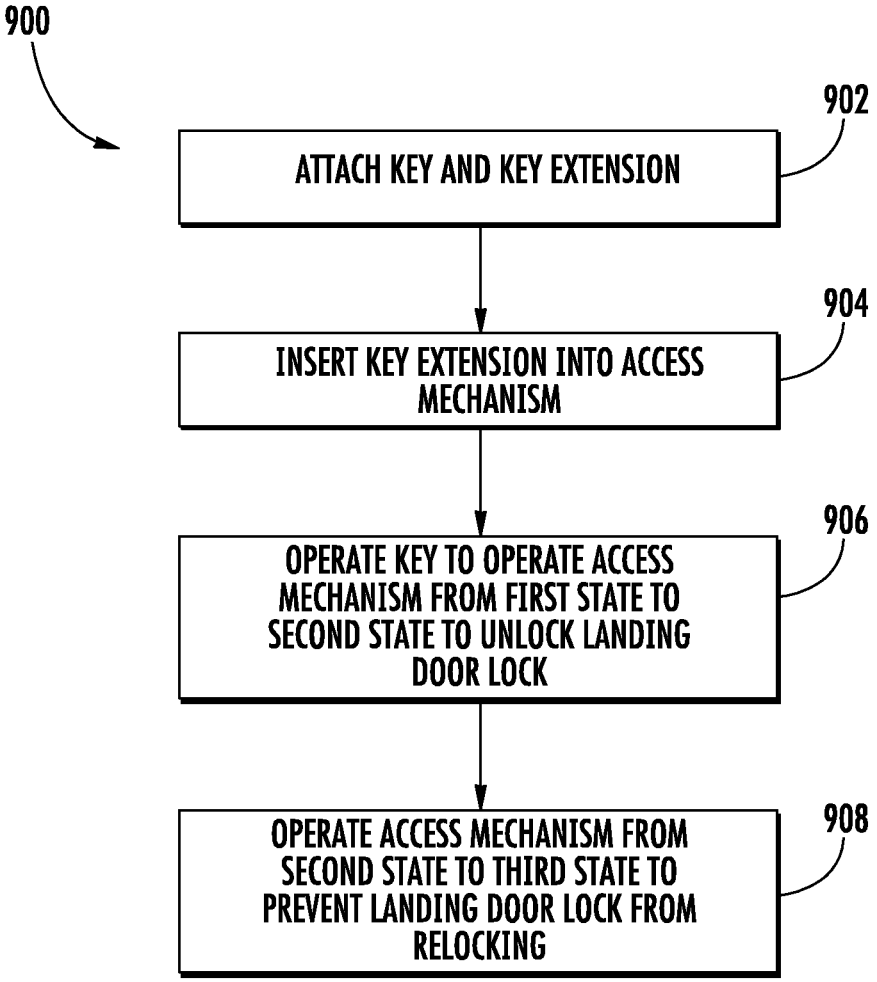
FIG. 9 is a flow process of an access operation for unlocking and opening a landing door of an elevator system in accordance with an embodiment of the present disclosure.

Turning now to FIG. 9, an access operation 900 for unlocking and opening a landing door of an elevator system in accordance with an embodiment of the present disclosure is shown. The access operation 900 can be performed using the embodiments shown and described herein and/or variations thereon.

At block 902, a key of an elevator system is attached to a key extension. The attachment of the key to the key extension can be between a first portion of the key extension and the key.

At block 904, the key extension is inserted into and engaged with a portion of an access mechanism. For example, the access mechanism can include an extension engagement element, as shown and described above, that is shaped and sized to engage with a second portion of the key extension. In some embodiments, the insertion of the key extension into the access mechanism can include a locked or secured engagement between the key extension and the extension engagement element such that the key extension cannot be removed from the extension engagement element once engaged therewith. In some embodiments, blocks 902 and 904 can be reversed such that the key extension is inserted into the access mechanism first, and then the key is engaged with the key extension.

At block 906, the key is used to operate the access mechanism from a first state to a second state to unlock a landing door lock. For example, rotation of the key can rotate the key extension to which the key is engaged. Rotation of the key extension will rotate a portion of the access mechanism, such as an opening element, to thus urge a portion of the landing door lock (e.g., a landing door pin) from a locked position into an unlocked position.

At block 908, the access system, and the access mechanism thereof, is operated from the second state to a third state to prevent the landing door lock from relocking. For example, at block 908, a blocking element of the access mechanism can move into a position to block or prevent movement of the landing door pin from moving back to a locked position. As such, the blocking element will prevent relocking of the landing door. In some embodiments, when the landing door pin is in the open position (as maintained by the blocking element) not only is mechanical relocking of the landing door prevented, but electrical locking of the landing door can be prevented as well. For example, in some embodiments, when the landing door lock is in the open/unlocked position, a safety chain is broken, which prevents electrical locking of the landing door, as will be appreciated by those of skill in the art.

In some embodiments, the secured engagement between the key extension and the extension engagement element will prevent removal of the key extension therefrom. Further, operation of the access mechanism can move the blocking element into position to prevent relocking of the landing door, and remain in such position. As such, to reset the landing door lock, in some embodiments, the entire access system may need to be replaced.

Advantageously, embodiments provided herein enable a secure unlocking mechanism that may prevent unauthorized access to elevator shafts. For example, in accordance with embodiments of the present disclosure, a key extension is required to manually operate the landing door lock and thus only persons having access to the key extension, plus a key, are enabled to unlock a landing door. Further, due to the secured engagement of the key extension with the access mechanism, reuse of the key extension can be prevented. In some embodiments, every landing of an elevator system can include an access system as shown and described herein. Alternatively, in some embodiments, a number less than all of the landings of an elevator system may include such access systems. For example, in one non-limiting embodiment, all landings but the first or ground floor landing of an elevator system may include an access system as described herein. In such arrangements, easier access to an elevator shaft is enabled at the ground floor (e.g., for maintenance in a pit or at the ground level), and more difficult access, achieved through inclusion of access systems as described herein. Thus, improper or unauthorized access to an elevator shaft at floors or heights above the ground floor can be prevented.

As used herein, the use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity).

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator access system comprising:

a key extension having a first portion arranged to engage with a key and a second portion; and an access mechanism having:

an extension engagement element arranged to receive and fixedly engage with the second portion of the key extension; and an opening element operably connected to the extension engagement element such that operation of the extension engagement element causes operation of the opening element, wherein the access mechanism further comprises a securing element and the key extension comprises a stop, wherein when the key extension is inserted into the access mechanism the securing element engages with the stop to prevent removal of the key extension from the access mechanism.

2. The elevator access system of claim 1, further comprising a housing, wherein at least the extension engagement element and the opening element are housed within the housing.

3. The elevator access system of claim 1, wherein the key extension comprises at least one protrusion and wherein the access mechanism includes at least one locking groove, wherein when the key extension is operated within the access mechanism the at least one protrusion moves within the at least one locking groove to prevent removal of the key extension after operation of the access mechanism.

4. The elevator access system of claim 1, wherein the access mechanism is installed in a landing door lintel of an elevator system.

5. The elevator access system of claim 4, further comprising:

a landing door pin operably connected to a landing door lock of the elevator system; and the access mechanism further comprises a blocking element arranged to prevent relocking of the landing door lock.

6. The elevator access system of claim 5, wherein the access mechanism has a first state in which the access mechanism does not interfere with operation of a landing door lock of an elevator system, a second state wherein the opening element operates to unlock the landing door lock, and a third state wherein the blocking element blocks movement of the landing door pin toward a locked position.

7. The elevator access system of claim 1, wherein the second portion includes an engagement aperture wherein the engagement aperture is arranged to provide secure and operable engagement between the key extension and the extension engagement element.

8. The elevator access system of claim 1, wherein the opening element is integrally formed with the extension engagement element.

9. An elevator system comprising:

an elevator shaft with an elevator car moveable within the elevator shaft; and a plurality of landings along the elevator shaft, each landing having a landing door; and an elevator access system installed at at least one of the landing doors, the elevator access system comprising:

a key extension having a first portion arranged to engage with a key and a second portion; and an access mechanism installed in a landing door lintel of the elevator system, the access mechanism having:

an extension engagement element arranged to receive and fixedly engage with the second portion of the key extension;

an opening element operably connected to the extension engagement element such that operation of the extension engagement element causes operation of the opening element;

a landing door pin operably connected to a landing door lock of the elevator system; and a blocking element arranged to prevent relocking of the landing door lock.

10. The elevator system of claim 9, further comprising a housing, wherein at least the extension engagement element and the opening element are housed within the housing.

11. The elevator system of claim 9, wherein the key extension comprises at least one protrusion and wherein the access mechanism includes at least one locking groove, wherein when the key extension is operated within the access mechanism the at least one protrusion moves within the at least one locking groove to prevent removal of the key extension after operation of the access mechanism.

12. The elevator system of claim 9, wherein the access mechanism further comprises a securing element and the key extension comprises a stop, wherein when the key extension is inserted into the access mechanism the securing element engages with the stop to prevent removal of the key extension from the access mechanism.

13. The elevator system of claim 9, wherein the access mechanism has a first state in which the access mechanism does not interfere with operation of a landing door lock of an elevator system, a second state wherein the opening element operates to unlock the landing door lock, and a third state wherein the blocking element blocks movement of the landing door pin toward a locked position.

14. The elevator system of claim 9, wherein the second portion includes an engagement aperture wherein the engagement aperture is arranged to provide secure and operable engagement between the key extension and the extension engagement element.

15. The elevator system of claim 9, wherein the opening element is integrally formed with the extension engagement element.

16. A method of unlocking a landing door of an elevator system, the method comprising:

inserting a key extension into an access mechanism of an access system, wherein insertion of the key extension engages the key extension with an extension engaging element of the access mechanism;

operating the key extension to transition the access system from a first state to a second state, wherein in the first state the access mechanism does not interfere with operation of a landing door lock of the elevator system and the transition from the first state to the second state unlocks the landing door lock; and operating the key extension to transition the access system from the second state to a third state, wherein in the third state the access mechanism prevents the landing door lock from returning to a locked state.

17. The method of claim 16, further comprising attaching a key to the key extension to enable manual operation of the key extension.

* * * * *